United States Patent [19]

Zehnder et al.

[11] 4,287,834

[45] Sep. 8, 1981

[54] STOPS OF A DRAFT GEAR HOUSING OF A RAIL CAR CENTRAL COUPLER ARRANGED IN A CENTER SILL

[75] Inventors: Jürg Zehnder; Erich Neumeier, both of Zurich, Switzerland

[73] Assignee: Swiss Aluminium Ltd., Chippis, Switzerland

[21] Appl. No.: 60,349

[22] Filed: Jul. 25, 1979

[30] Foreign Application Priority Data

Feb. 5, 1979 [CH] Switzerland ..... 1100/79

[51] Int. Cl.[3] ..... B61F 1/00; B61F 1/08

[52] U.S. Cl. ..... 105/420; 213/9

[58] Field of Search ..... 213/7, 9, 10, 40 R, 213/51, 54, 58; 105/420, 416, 417, 418

[56] References Cited

U.S. PATENT DOCUMENTS

| | | | |
|---|---|---|---|
| 2,115,038 | 4/1938 | Moses | 105/420 |
| 2,226,724 | 12/1940 | Kepner | 213/9 |
| 2,250,600 | 7/1941 | Pancake | 213/9 |
| 3,677,198 | 7/1972 | Yang et al. | 105/420 |
| 4,029,022 | 6/1977 | McClurg | 105/420 |

*Primary Examiner*—Richard A. Bertsch

*Attorney, Agent, or Firm*—Bachman and LaPointe

[57] ABSTRACT

The stops of a draft gear housing of a rail car central coupler have to meet relatively large tractive and compressive forces in service. Up to now the expense involved in the fastening of such stops has been very great. In many cases, where the stops or bearings were joined to the center or stub sill, cracks formed and/or the sill became deformed. This incurs considerable expense for repairs and means a loss of service while the vehicle is being repaired. In accordance with the instant disclosure, to avoid such problems the center or stub sill of the rail car is now made such that the front stop and the rear stop are integral parts of the sill.

10 Claims, 8 Drawing Figures

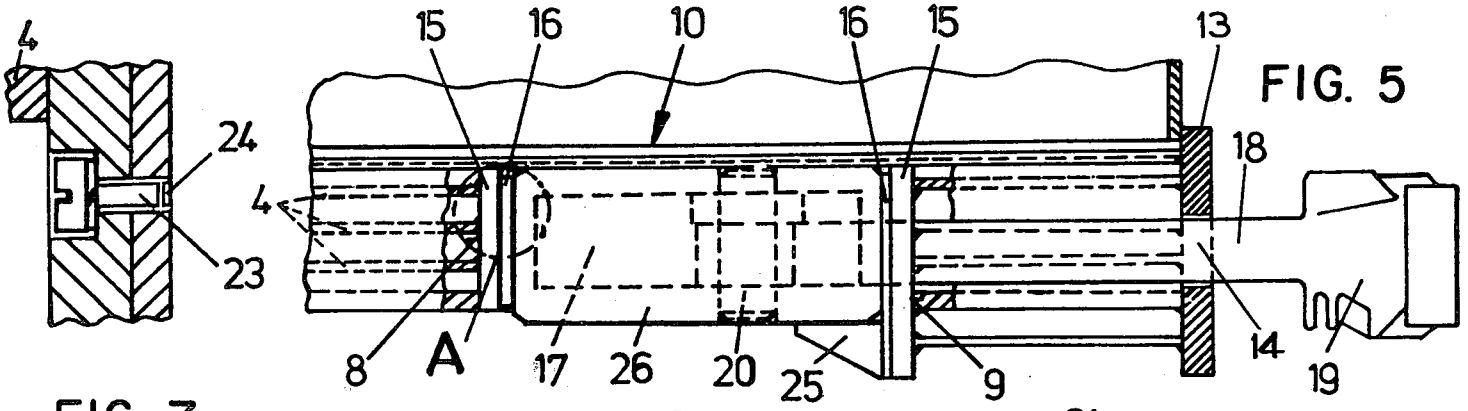
FIG. 5
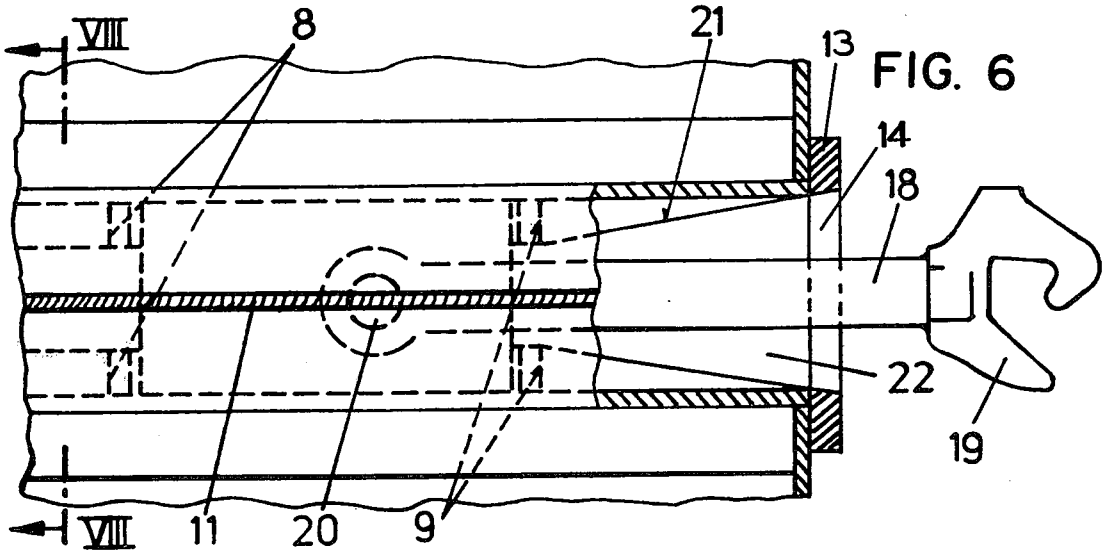
FIG. 6
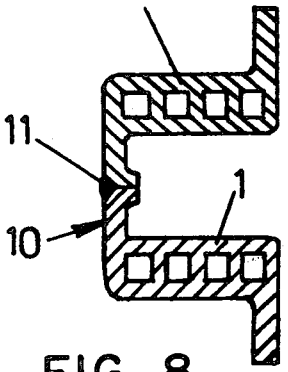
FIG. 7
FIG. 8

STOPS OF A DRAFT GEAR HOUSING OF A RAIL CAR CENTRAL COUPLER ARRANGED IN A CENTER SILL

BACKGROUND OF THE INVENTION

The invention presented here relates to stops for a draft gear housing of a preferably automatic central coupler in a center sill or stub sill of a rail car by means of which the forces involved during pushing and pulling the rail car are taken up. The draft gear housing is situated in at least one space in a single or two part center or stub sill, which is provided with longitudinal struts or ribs.

In North America in particular, pushing or pulling individual vehicles, especially railway vehicles, is carried out via a so-called central coupler which is connected to a device designed to take up the tractive and compressive forces involved.

What is known for example is a draft gear housing of a preferably automatic central coupler in a U-shaped center or stub sill to take up the tractive and compressive forces. The said housing can be formed by the center sill or stub sill and by means of stops or bearings mounted on the sidewalls of the sill in order to meet the tractive and compressive forces acting on the said housing.

The stops which take up the forces, arising in service, are fixed by conventional means, e.g. screws and/or rivets or by welding to a center sill. The expense involved however is relatively large. It should also be noted that fixing stops this way can often give rise to cracks and/or deformation at the place of fixing. This can in turn lead to considerable extra expense for repairs, and will result in the rail car being out of service for a period while it is being repaired.

SUMMARY OF THE INVENTION

The object of the present invention is therefore to develop stops or bearings for the draft gear of a central coupler arranged in a space of a center sill or stub sill of a rail car which will meet the tractive and compressive forces which arise there, and by means of which device the previously described disadvantages of the above-mentioned known stops or bearings on the center sills or stub sills are avoided.

The object is achieved by way of the present invention in that the front and rear stops for the draft gear housing are integral components of the center or stub sill.

Throughout the present specification both center and stub sills are contemplated; however, for simplicity only the term "center sill" is utilized.

BRIEF DESCRIPTION OF THE DRAWINGS

Further advantageous exemplified embodiments of the present invention are apparent from the following description and from the figures which show a simplified schematic representation of an exemplified embodiment of the invention viz.

FIG. 5: A side view of a center sill with a device in a recess in the sill in order to take up the tractive and compressive forces produced in a central coupler fitted to the center sill.

FIG. 6: A plan view of the center sill shown in FIG. 5.

FIG. 7: The fixing of a wear resistant plate (16) to an adaptor plate (15) in the region encircled by the broken line A in FIG. 5, but shown here on a larger scale.

FIG. 8: A cross section through the center sill along line VIII—VIII in FIG. 6.

DETAILED DESCRIPTION

Figure 1:
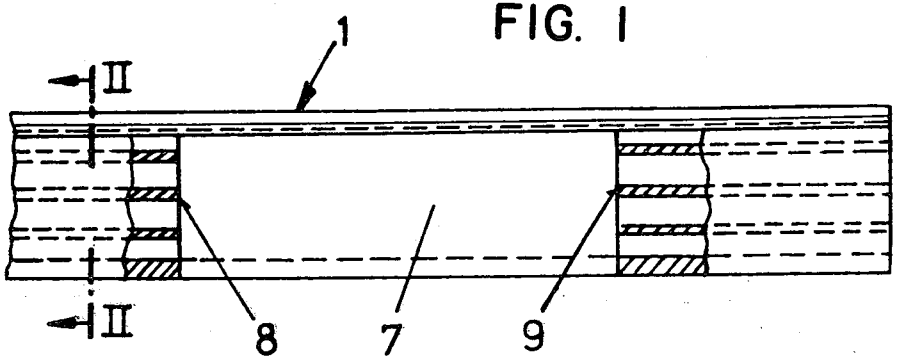
FIG. 1: A side view of a Z-shaped hollow section which is partially cut away and features a recess and bearings.
Figure 2:
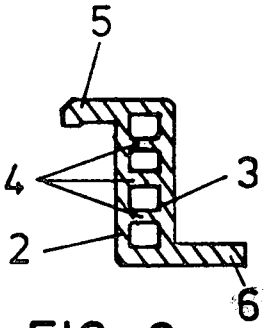
FIG. 2: A cross section through the Z-shaped hollow section in FIG. 1, sectioned along line II—II.
Figure 3:
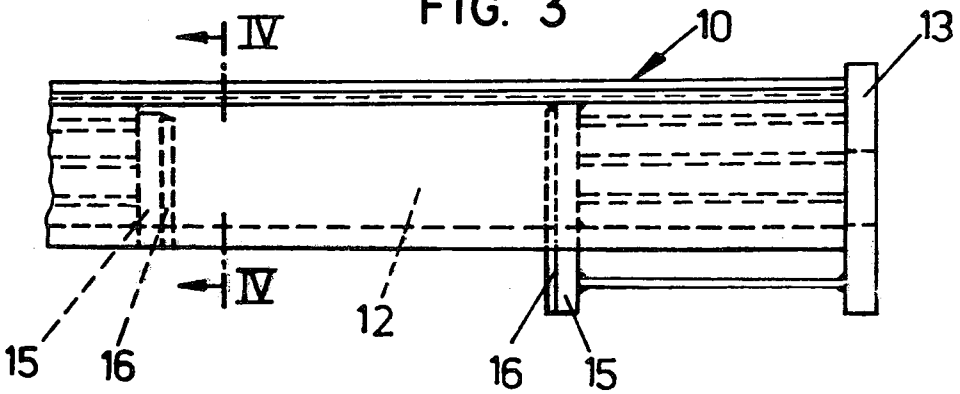
FIG. 3: A side view of a center sill with a chamber and with adaptor and wear resistant plate inset in the chamber.
Figure 4:
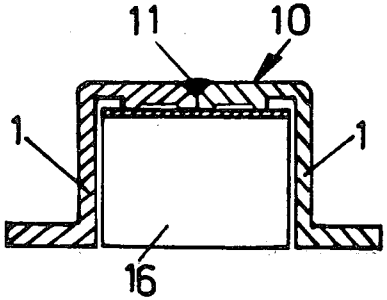
FIG. 4: A cross section through the center sill in FIG. 3, along line IV—IV.

The Z-shaped beam 1, which is produced preferably by extrusion and is shown here in FIGS. 1 and 2, is in the form of a hollow section with two parallel sidewalls 2 and 3 which are joined by struts 4. At the upper end of wall 2 and the lower end of wall 3 there are struts 5 and 6 respectively, which form a Z-shape together with the essentially vertical sidewalls 2 and 3.

The Z-shaped hollow section 1 is provided with a recess 7, which is formed by removing the inner wall 2 and the struts 4, preferably by means of chip-forming machines not shown here. This recess 7 serves as a space for building in a draft gear housing of a central coupler facility (not shown) which takes up the forces due to pushing and pulling the vehicle when in service.

On removing the inner wall 2 and struts 4, in addition to forming the recess 7, stops 8 and 9 are provided as rear push stop 8 and forward pull stop 9 respectively at the ends created as a result of removing the inner wall 2 and struts 4.

The Ω-shaped center sill 10 shown in FIGS. 3–8 comprises a single section or two of the previously described hollow sections 1 joined at the upper struts 5 by a weld 11 along the full length in such a way that the recesses 7 in the Z-shaped sections face each other and together form a chamber 12. A front plate or striker 13 is secured at least at one end of the center sill 10 and is provided with a hole 14 which runs horizontally. An adaptor plate 15 and a wear resistant plate 16 can be fitted or welded to the struts 4 at both stops 8 and 9 and joined for example by means of screws or rivets, as can be seen from FIGS. 3, 4, 5 and 7.

FIGS. 5 and 6 show the arrangement of a draft gear 17 in the chamber 12 whereby an arm 18 of a central coupler 19 is hinged about a vertical axis 20. The draft gear 17, which is shown here schematically, takes up the tractive and compressive forces acting on the central coupler 19 when in service.

As can be seen in FIG. 6, the struts 4 and the inner walls 2 at the end of the center sill 10 are removed, preferably by machining and in such a way that an opening 22, which becomes wider from the chamber 12 to the end 21 of the center sill 10, is created. The opening 22 connects up to the already mentioned longitudinal hole 14 in the face plate 13.

As can be seen in FIGS. 3 to 7, the center sill 10 features in total four adaptor plates 15 which are joined or welded in the region of the stops 8 and 9 to the struts 4 and the inner walls 2 of the hollow beam 1, as FIG. 7 shows. The plate 16, which is made of particularly wear resistant material, is held preferably by means of screws 23 which can be screwed into the threaded holes 24 in the plate 16. This allows the plate 16 to be readily changed for a new one after a predetermined period of service. The plate 16 can, if desired, also be riveted to the adaptor plate 15, in a manner not shown here.

The draft gear 17 which takes up the compressive and tractive forces of the central coupler 19 is held in chamber 12 with the aid of fittings 25 and other securing means which are not shown in detail here. In connection with this it should be mentioned in particular that the draft gear 17 is, in the sense of the present invention, not limited to the embodiment shown in FIGS. 5 and 6, and that other embodiments not shown here are also possible.

In the exemplified embodiment shown, the draft gear 17 is completely surrounded by a yoke 26. It is however also conceivable that a housing which is not fully closed could also be employed.

It is for example also possible to join the plate 16 and the adaptor plate 15 to the yoke 26, if this were desired.

With respect to the shape of the Z-shaped beam 1, it should be mentioned in particular that it is also within the scope of the invention to employ a Z-shaped beam only with struts 4, without wall 2, with the struts running preferably in the longitudinal direction instead of a hollow beam.

The stops for taking up the compressive and tractive forces of a central coupler are relatively simple in construction, as the stops usefully form a unit together with the center sill. Consequently there are no screws, nuts or rivets, etc. required to fasten such bearings or stops to a center sill, where, as was the case up to now, cracks could form and/or deformation could occur to the center sill.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a sill of a rail car having stops for a draft gear housing of a central coupler in at least one space in said sill, said draft gear housing being secured in said space, wherein the said sill is provided with longitudinal struts or ribs discontinuous at said space, and including front stops and rear stops for pushing and pulling the draft gear, provided that said stops are integral components of the sill, are provided at the location of the discontinuity and the front stops and the rear stops for the draft gear are created by removing material from the sill or struts, wherein said stops meet the tractive and compressive forces arising in use.

2. In a sill according to claim 1 wherein two longitudinal parts of the sill are welded together and wherein the front stops and the rear stops are created before said welding by removing material from the longitudinal ribs or struts of the sill.

3. In a sill according to claim 1 wherein the front stops and the rear stops are arranged at such a distance from each other that they form the front and rear limits of a space into which a draft gear of a preferably automatic central coupler is installed.

4. In a sill according to claim 1 wherein on each of the stops an adaptor plate and a wear resistant plate is mounted.

5. In a sill according to claim 1 wherein said sill is a two-part sill.

6. In a sill according to claim 1 wherein said sill is a center sill.

7. In a sill according to claim 6 including a front plate or striker with a hole therein secured to at least one end of said center sill.

8. In a sill according to claim 7 including an opening extending from said space to said hole which becomes wider from the space to the hole.

9. In a sill according to claim 1 wherein said draft gear is surrounded by a yoke.

10. In a sill according to claim 1 wherein said sill comprises at least one extruded beam.

* * * * *